United States Patent [19]

Laine

[11] 4,192,537

[45] Mar. 11, 1980

[54] SAFETY DEVICE FOR DOORS, WINDOWS AND SIMILAR

[76] Inventor: Yrjö T. Laine, Niemenmäentie 12 A 26, 00350 Helsinki 35, Finland

[21] Appl. No.: 963,563

[22] Filed: Nov. 20, 1978

[30] Foreign Application Priority Data

Apr. 27, 1978 [FI] Finland ..... 78-1318

[51] Int. Cl.[2] ..... E05C 17/36

[52] U.S. Cl. ..... 292/264; 70/93; 70/461; 292/341.18; 292/DIG. 60

[58] Field of Search ..... 297/264, 341.18, 340, 297/262, 268, 276, 57, DIG. 53, DIG. 60; 70/93, 461

[56] References Cited

U.S. PATENT DOCUMENTS

| | | | |
|---|---|---|---|
| 265,474 | 10/1882 | Voll | 292/DIG. 53 |
| 2,200,627 | 5/1940 | Levy et al. | 292/262 |
| 2,205,845 | 6/1940 | Cochran | 70/461 X |
| 3,071,958 | 1/1963 | Russo | 292/264 X |

FOREIGN PATENT DOCUMENTS

| | | |
|---|---|---|
| 1913643 | 9/1970 | Fed. Rep. of Germany . |
| 1476982 | 6/1977 | United Kingdom . |

*Primary Examiner*—William E. Lyddane
*Attorney, Agent, or Firm*—Cushman, Darby & Cushman

[57] ABSTRACT

A safety device for doors comprising a cylindrical housing going through to the door, a locking pin to be locked in the housing and a chain one end of which is locked to the pin and the other end being attached to the door frame. The housing is attached to the door by means of two flanges, one on each side of the door, the spacing of which is adjustable.

5 Claims, 5 Drawing Figures

SAFETY DEVICE FOR DOORS, WINDOWS AND SIMILAR

Figure 2:
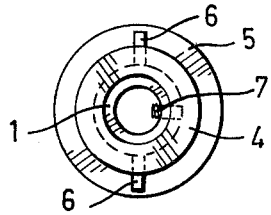

The present invention relates to a safety device for doors, windows and similar, comprising a locking device attached to a movable part and comprised of a cylindrical housing, a pin placed in the housing and a locking means for locking the pin in the housing in a certain turning position, and further comprising a safety chain or similar attached to the outer end of the pin, the other end of said chain being attached to an immovable part, such as a frame, and said housing being provided with means for attaching it to said movable part.

In the technical solution of presently commonly used safety chains the fixed end of a chain, wire or similar is attached to a door frame or to one of the double doors. The loose end of the chain is arranged to slide inside a guide fastened on the door. The chain is dimensioned so that its loose end, when located in the closed end of the guide, permits the door to be slightly opened. In order to open the door fully, the door must first be closed whereby the loose end of the chain may be removed through the open end of the guide and the door be opened.

From Swedish patent publication No. 7308105-1 there is known a safety device for windows in which a lock housing to be locked with a key is attached to the frame and fastened through an arm to a chain the other end whereof is attached to a loop in the head of a bolt. The bolt is passed through a window pane frame and fixed in its proper location by means of a nut on the opposite surface of the frame. The lock housing is mounted on the frame by means of pins locked to the frame by means of transverse screws extending through the pins.

From DOS No. 1,913,643, on the other hand, there is known a safety chain device in which one end of a chain is attached to a pin which can be locked in to a cylindrical housing and removed from it by means of a key with which the operation of the lock housing is controlled. The cylindrical housing and the key housing are arranged in a common casing fixed by means of screws to the inner surface of a car door.

The disadvantage of this arrangement is that both the fixed end of the chain and the guide or locking means are fastened as a surface installation with screws both to the frame and the door to be opened. Due to this, it is possible by using force to pull the slightly opened door open whereby the fixing screws yield to the pulling. This is nowadays quite easy as, instead of all-wooden doors, doors of a lighter construction are being increasingly used and the hold of the fixing screws in these doors is very poor.

It is the object of the present invention to provide a safety device in which the locking device can be fixed to the door so firmly that it cannot be removed from it without breaking the door and in which the locking device is so constructed that it forms a part of the fixing arrangement whereby a firm fixation is obtained with the smallest possible number of additional parts. This object is in principle achieved so that the cylindrical housing forms a fixing pin extending through the door. This is defined in the characterizing clause of the accompanying claim 1 so that the housing is made of a sleeve provided with an outer thread and that the fixing means of the housing is comprised of two flanges surrounding the sleeve, at least one of said flanges being located on a socket to be threaded on the sleeve in order to adjust the relative distance between the flanges, and the flanges being arranged to be pressed against the opposite outer surfaces of the movable part. By means of the device according to the invention, a firm fixation is obtained in the simplest possible manner as the housing has two functions, i.e. it serves as a housing for the pin and a fixing pin for the locking device.

Figure 1:
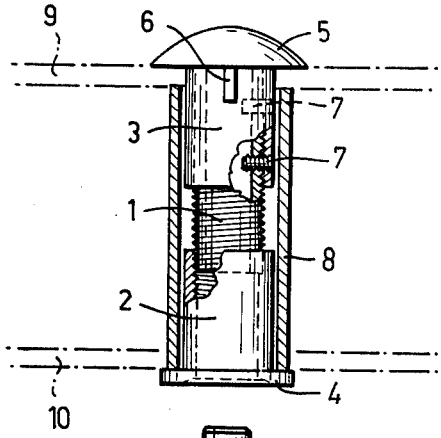
Figure 3:
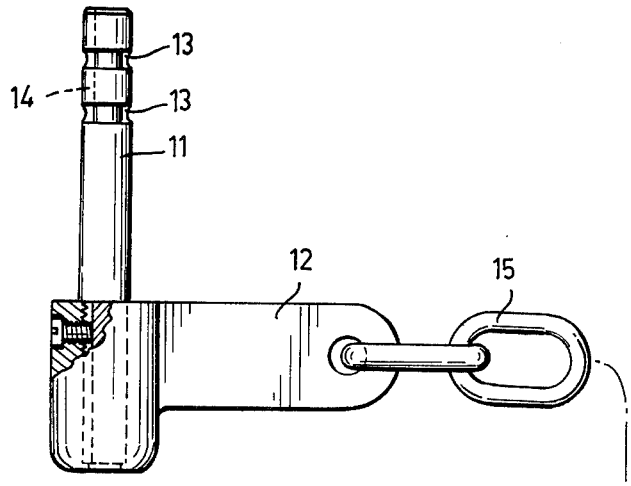
Figure 4:
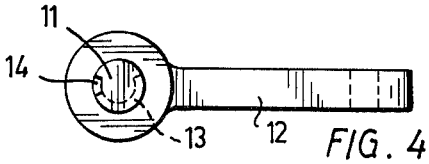
Figure 5:
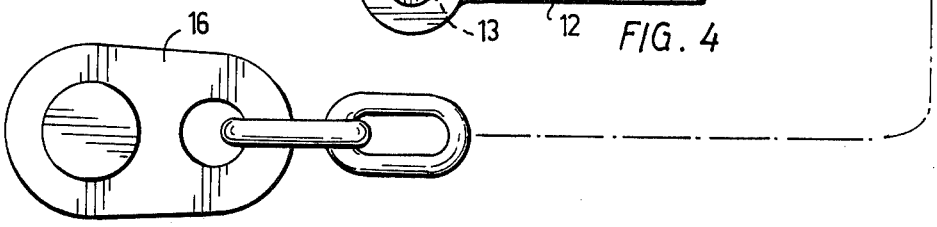

One preferred embodiment of the safety device according to the invention will be described in more detail in the following with reference to the accompanying drawing in which FIG. 1 is a side view of the housing and its sockets, FIG. 2 is an end view of the housing, FIG. 3 is a side view of the pin and the handle attached thereto, FIG. 4 is an end view of the pin, and FIG. 5 illustrates one example of the fixing means of the chain.

In FIGS. 1 and 2, there is shown a sleeve 1 forming a housing and provided with an outer thread, sockets 2 and 3 being threaded on both ends of said sleeve. The outer end 2 of the socket 2 is provided with a ring flange 4 and the outer end of the socket 3 is provided with an outwardly convex flange 5 closing the end of the socket. A few ribs 6 are arranged in the angle between the flange 5 and the outer surface of the socket 3. The socket 3 and the sleeve 1 are provided with two radial holes arranged in register with each other, through which holes two guide screws 7 are threaded which at the same time lock the socket 3 to the sleeve 1 so as to prevent them from turning in relation to each other. The sleeve 1 and the sockets 2, 3 are, in addition, surrounded by a straight pipe 8 extending from the inner surface of the flange 4 to the inner surface of the outer door panel 9. The inner door panel is designated with reference numeral 10.

In FIGS. 3 and 4, there is shown a pin 11 of the safety device according to the invention and a handle 12 connected thereto. The handle, which has a cylindrical portion and a blade portion, can be connected to one end of the pin, for example, in the manner shown in FIGS. 3 and 4 according to which the pin and the hole extending through the cylindrical portion are provided with threads fitting into each other so that the handle can be threaded on the pin as much as required by the thickness of the door in each particular case. The pin is provided with a longitudinal slot into which the screw extending through the handle penetrates and at the same time locks the visible portion of the pin to the desired length.

One end of the pin 11 is provided with two transverse slots 13, the length whereof is equal to one half of the pin periphery, for the guide screws 7 and a longitudinal slot 14 connecting one end of the transverse slots to the end of the pin so as to allow the front end of the pin to be pushed past the guide screws.

In the hole of the handle blade is fastened a chain 15 or similar means which at its other end is attached to a fixing means 16 fixed to a door frame or to the door usually kept closed in a double door.

As shown in FIG. 1 with dotted broken lines, the sleeve 1 and the socket 3 attached thereto are placed from the outside in a hole extending through the door, whereafter the socket 2 is threaded on the sleeve from the inside until the inner surface of the flange 4 abuts the inner end of the pipe 8 and the ribs 6 are embedded in the outer panel of the door, thereby preventing the socket 3 from being detached from the outside by means of turning the flange 5. In this way a housing is provided which is open on the inside and into which the pin 11 can be pushed and locked by means of the guide screws 7 and transverse slots 13.

When one wants to open the door slightly with the safety chain engaged, the pin is pushed into the housing and the handle is turned toward the fixing means 16 whereby the pin is locked into the housing and the door can be slightly opened. If one thereafter wants to open the door wide open, it must again be closed whereby the handle can be turned 180°. The pin can now be removed from the housing whereby the engagement between the door and the fixing means 16 is disconnected.

Differing from the foregoing, the socket 3 may naturally be omitted, in which case the flange 5 must be attached directly to the end of the sleeve 1. Instead of two guide screws 7, only one guide screw may, if required, be used and also the pipe 8 may be omitted if the surface panels of the door resist pressure without being pressed against each other.

I claim:

1. A safety device for doors, windows and similar, comprising a locking device attached to a movable part and comprised of a cylindrical housing a pin placed in the housing and a locking means for locking the pin in the housing in a certain turning position, and further comprising a safety chain or similar, attached to the outer end of the pin, the other end of said chain being attached to an immovable part, such as a frame, and said housing being provided with means for attaching it to said movable part, the improvement comprising that the housing is made of a sleeve provided with an outer thread and that the fixing means of the housing is comprised of two flanges surrounding the sleeve, at least one of said flanges being located on a socket to be threaded on the sleeve in order to adjust the relative distance between the flanges, and the flanges being arranged to be pressed against the opposite outer surfaces of the movable part.

2. A safety device as claimed in claim 1, wherein the flange to be placed on the outer surface of the movable part is rounded on its outer surface and is without a central opening.

3. A safety device as claimed in claim 1, wherein the flange to be placed on the outer surface of the movable part is on its surface to be placed against said outer surface provided with ribs.

4. A safety device as claimed in claim 1, wherein the flange to be placed on the outer surface of the movable part is located on a socket surrounding the sleeve, said socket being locked on said sleeve with at least one radial screw serving as guide screw for the locking means between the pin and the sleeve.

5. A safety device as claimed in claim 1, wherein a pipe length is provided around the sleeve between the flanges, said pipe length determining the minimum distance between the flanges.

* * * * *